US007748549B1

(12) United States Patent
Browning

(10) Patent No.: US 7,748,549 B1
(45) Date of Patent: Jul. 6, 2010

(54) AIR HOSE COUPLING DEVICE

(75) Inventor: Don Robert Browning, Salem, VA (US)

(73) Assignee: Norfolk Southern Corporation, Norfolk, VA (US)

( * ) Notice: Subject to any disclaimer, the term of this patent is extended or adjusted under 35 U.S.C. 154(b) by 97 days.

(21) Appl. No.: 11/823,623

(22) Filed: Jun. 27, 2007

(51) Int. Cl.
*B61G 5/06* (2006.01)
*B61G 5/08* (2006.01)

(52) U.S. Cl. ..... 213/76; 213/75 R; 213/75 GT

(58) Field of Classification Search ..... 213/75 R, 213/75 GT, 76
See application file for complete search history.

(56) References Cited

U.S. PATENT DOCUMENTS

| | | | | |
|---|---|---|---|---|
| 1,437,645 | A | 12/1922 | Genin | |
| 1,517,785 | A | 12/1924 | Kothe | |
| 1,644,975 | A | 10/1927 | Barber | |
| 1,737,271 | A | 11/1929 | Schmoll | |
| 1,750,398 | A | 3/1930 | Francis | |
| 1,804,509 | A | 5/1931 | Noffsinger | |
| 1,987,868 | A | 1/1935 | Petznick | |
| 1,990,651 | A * | 2/1935 | Johnson | 213/76 |
| 2,000,726 | A | 5/1935 | Weber | |
| 2,231,028 | A | 2/1941 | Robinson | |
| 2,819,913 | A | 1/1958 | Kayler | |
| 2,934,217 | A | 4/1960 | Simmons et al. | |
| 3,591,017 | A | 7/1971 | Cope | |
| 3,802,578 | A | 4/1974 | Farnworth | |
| 3,854,597 | A | 12/1974 | McClure et al. | |
| 4,071,148 | A | 1/1978 | Tibbs | |
| 4,703,862 | A | 11/1987 | Werner | |
| 6,290,079 | B1 * | 9/2001 | Altherr | 213/1.3 |

* cited by examiner

*Primary Examiner*—S. Joseph Marano
*Assistant Examiner*—Zachary Kuhfuss
(74) *Attorney, Agent, or Firm*—Kevin Grierson

(57) ABSTRACT

The present invention describes an automatic hose connector for a railway car, comprising a coupler head adapted to mate with the corresponding coupler head of another railway car. The coupler head is comprised of concave and convex male and female coupling means, and each said coupling means includes an airway for joining with the corresponding airway of the coupler head of another railway car. Finally, there is at least one internal channel joining the male and female coupling means airways.

14 Claims, 5 Drawing Sheets

AIR HOSE COUPLING DEVICE

BACKGROUND OF THE INVENTION

1. Field of the Invention

The present invention relates to air hose coupling devices for rail cars. More specifically, the present invention is directed to a coupling device that allows the joining of air hoses of adjacent cars without the need for manual coupling. A preferred embodiment of the invention comprises an automatic air hose coupling device with a combined male/female coupler head that attaches to standard air hoses via a standard gladhand fitting, permitting the automatic coupler to be disengaged when a railcar is joined with another car that is not similarly equipped with the automatic coupler.

2. Background of the Invention

When assembling a train of railroad cars for transport, it is necessary to mechanically connect them together. It is generally also necessary to connect their electrical and compressed air braking systems. In North America, the mechanical connection of the virtually all freight cars is accomplished through a "knuckle" or AAR Type "E" coupler. Knuckle couplers allow rail cars to be mechanically joined by simply pushing them together; no manual coupling is required. Knuckle couplers are also the strongest coupler in general use today. The design of the knuckle coupler has not changed much since Eli H. Janney obtained U.S. Pat. No. 138,405 for the "Janney" coupler in 1873.

Unfortunately, the knuckle coupler does not provide air brake or other non-mechanical connections automatically. The air brake connections must still be made by workers who connect the air hose from one car to the next by hand. The use of manual air brake couplers thus requires more workers and imposes greater risk than would an automated system in which the air hoses were coupled automatically when the knuckle couplers were engaged.

Several fully automatic coupling systems exist that provide for both mechanical and air hose connections without the need for human intervention. The most common of these is the Scharfenberg coupler, which is used in Europe and elsewhere. However, the Scharfenberg and other fully automatic couplers in use today suffer from two primary disadvantages: First, they are generally only suited for passenger operations, because the mechanical coupler of such automatic couplers usually has a much lower maximum tonnage than a knuckle coupler. Second, none of the fully automatic couplers in use today is compatible with the knuckle coupler, which means that they cannot be used on trains in the United States unless all the cars for a train are fitted with the new couplers. Because there are literally millions of railcars in the United States and Canada with knuckle couplers, and because cars may change trains one or more times en route from one location to another, an "all or nothing" automatic coupler that does not permit incremental introduction is, for all practical purposes, impossible to implement in the United States.

BRIEF DISCUSSION OF PRIOR ART

U.S. Pat. No. 1,737,271, U.S. Pat. No. 1,804,509 and U.S. Pat. No. 1,644,975 disclose early attempts to provide an automatic hose coupler for railcars using knuckle couplers. Like the present invention, they provide for the use of both male and female connectors on the connector head; however, the airway connection is not made through the male and female connectors, but through a central airway. These designs also lack the ability to allow the connector head to pivot independently of the drawbar of the knuckle coupler. Furthermore, although the regular manual connectors can be used while the automatic connector is being put in place, once installed the manual hose is removed and that airway is capped, which means that each railway car with an automatic coupler must be paired with another car with an automatic coupler.

SUMMARY OF THE INVENTION

It is an object of the present invention to provide an air hose coupling device for rail stock that couples automatically when two rail cars are placed in proximity such that the cars' knuckle couplers engage each other.

A further object of the present invention is to provide an automatic coupling device that will mate with the same device on another car, obviating the need for "male" and "female" couplers, and allowing the air hose connection to be made regardless of the orientation of the rail cars to each other.

A further object of the present invention is to provide an automatic air hose coupler that can work with rail cars not equipped with the new automatic coupler by bypassing the automatic coupler and allowing the coupling of air hoses by conventional means, thus allowing the incremental introduction of the new device.

A further object of the present invention is to provide an automatic air hose coupling device that can be installed on rail cars without otherwise modifying the existing coupling or air hose assembly.

The objects of the present invention are obtained by the automatic air coupler described in more detail below.

Additional objects and advantages of embodiments of the invention will be set forth in part in the description that follows, and in part will be obvious from the description, or may be learned by practice of the invention. The objects and advantages of the invention will be obtained by means of instrumentalities in combinations particularly pointed out in the claims.

LIST OF FIGURES

DETAILED DESCRIPTION OF THE INVENTION

Figure 1:
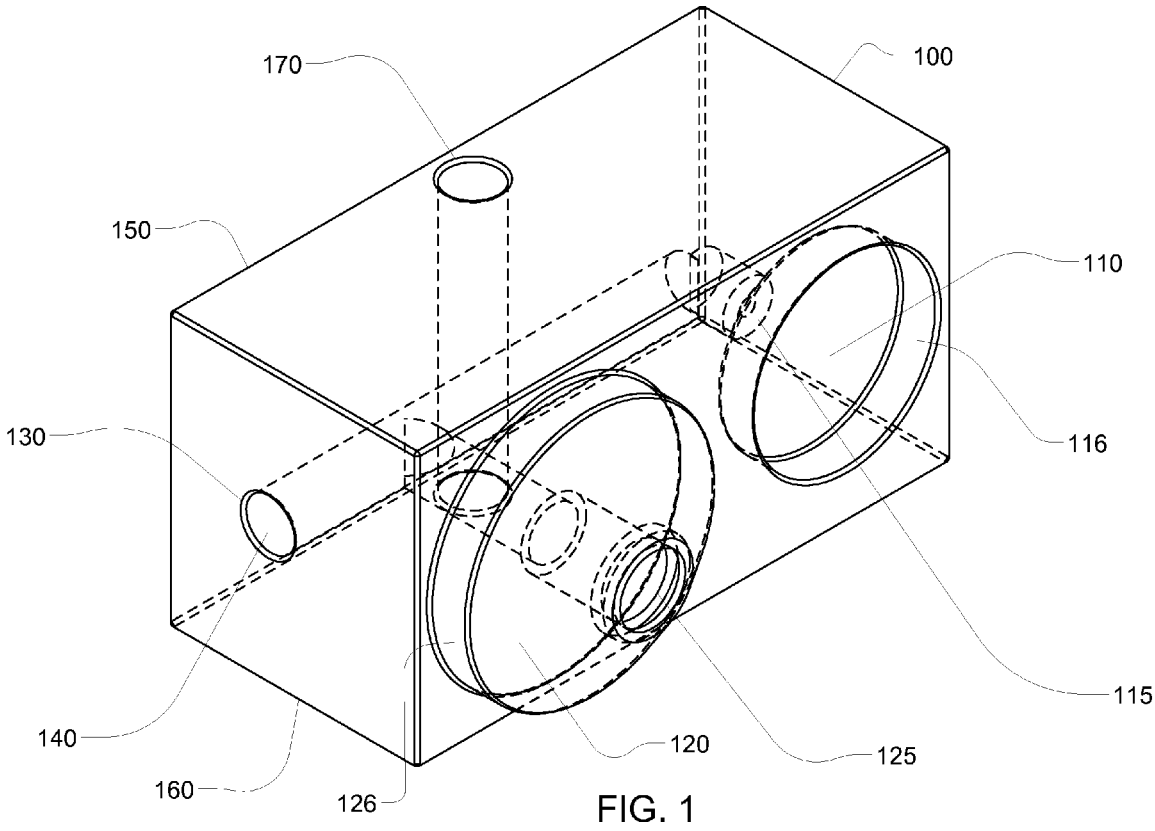
FIG. 1 shows a perspective view of the coupler head.

In a preferred embodiment, as shown in FIG. 1, a coupler head 100 comprises a housing with a concave (female) coupling means 110 and a convex (male) coupling means 120 for mating with a corresponding male coupling means and female coupling means of the coupler head of another rail car. Each coupling means has an airway 115, 125. The female coupling means preferably has a flexible grommet of rubber or a flexible synthetic material surrounding the entrance to the airway that permits an airtight seal with the corresponding male coupling means of the adjacent railcar to which it is joined. Both the female and male coupling means preferably have a flat lip 116, 126 to stabilize the coupling means when joined to prevent slippage due to vertical movement of the railcars relative to each other.

The airways in each coupling means joint to form a single internal channel 140, which exits the couple head from a surface not containing a coupling means, such as the back 150 or the side 160. This exit preferably is fitted with an attachment means such as a gladhand fitting 130 for attaching a standard air brake air hose. If the adjacent railcar does not have an automatic coupler, this arrangement allows the air hose to be detached from the automatic coupler and connected to the hose of the adjacent rail car in the conventional, manual manner.

Figure 2:
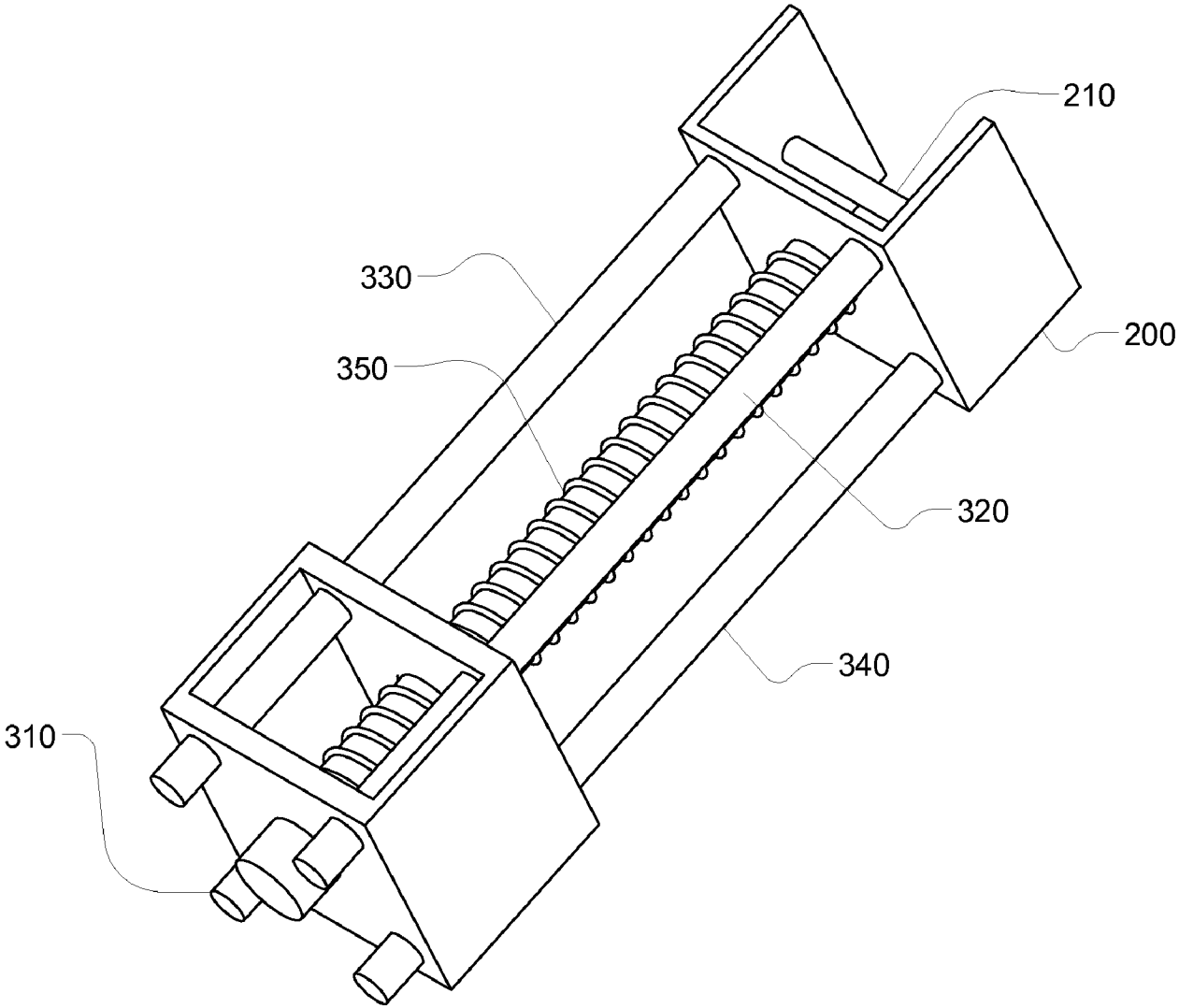
FIG. 2 shows a perspective view of the coupler housing and the mounting bracket.

As shown in FIG. 2, the coupler head 100 is preferably rotatably mounted to a yoke 200 by a clevis pin 210 inserted through a hole 170 in the coupler head. The yoke is attached to a Rear Assembly by a plurality of struts 310, 320, 330, and 340 that dispose the coupler head below the knuckle coupler, facing the same direction. These struts are preferably adjustable in length, and contain a spring or other tension mechanism 350 to push the coupler head toward the complementary coupler head of the adjacent railcar, creating and maintaining a seal when the cars are mechanically coupled together.

Figure 3:
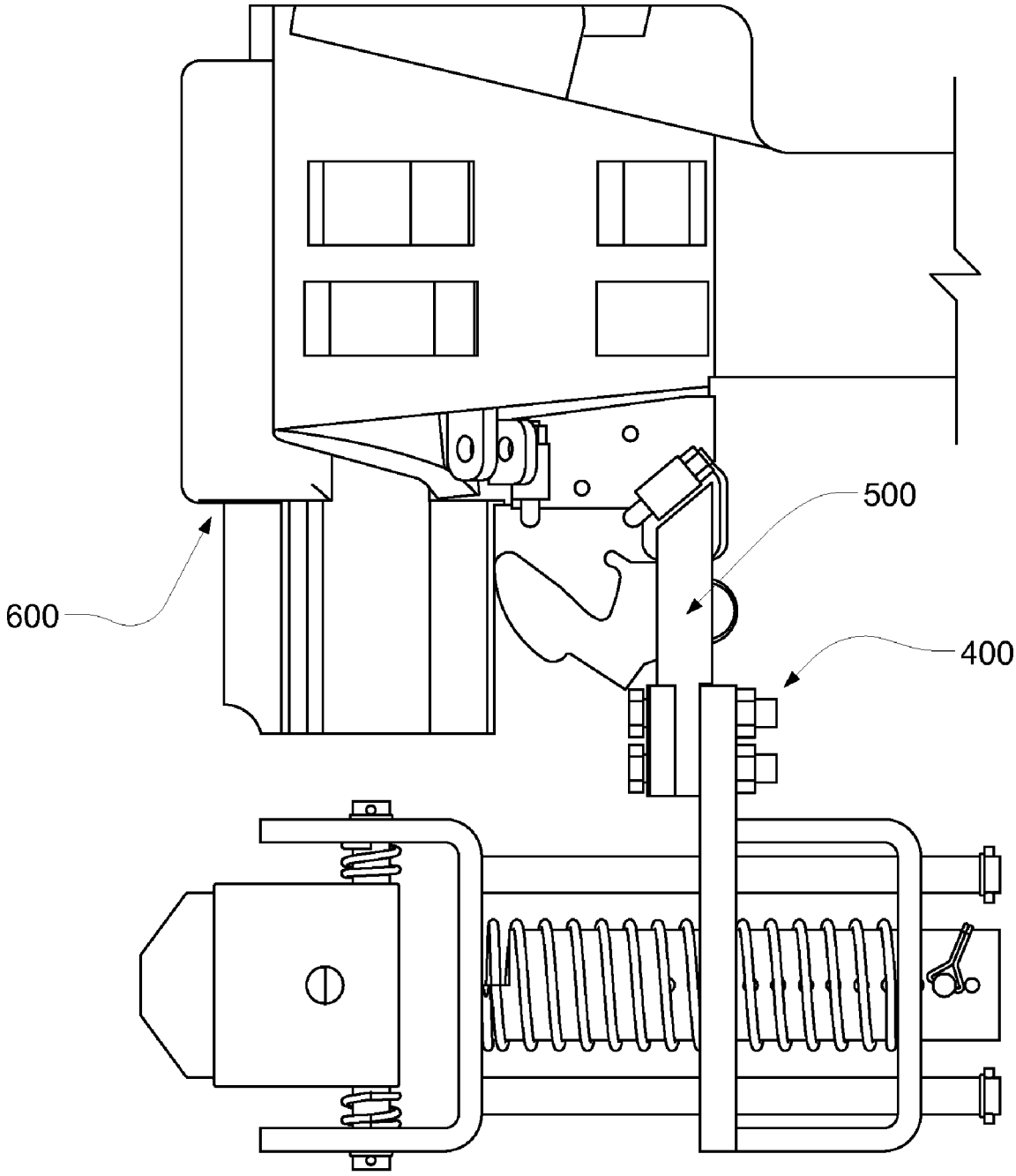
FIG. 3 is a side view showing the automatic air hose coupler as mounted to the drawbar of a knuckle coupler.

As shown on FIG. 3, the Rear Assembly is rigidly connected to a mounting bracket 400 which is itself rigidly affixed to the rotary shaft housing 500 of the knuckle coupler immediately behind the knuckle assembly 600. The entire air hose coupler assembly therefore moves with the drawbar, keeping the coupling head in a fixed position relative to the knuckle coupler.

Figure 4:
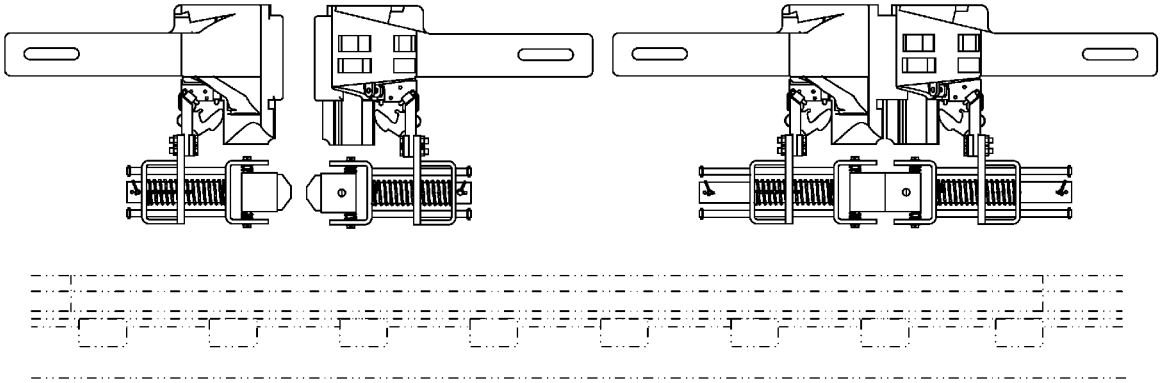
FIG. 4 shows a side view of two airhose couplers approaching each other, then joining as the knuckle couplers of the cars engage.
Figure 5:
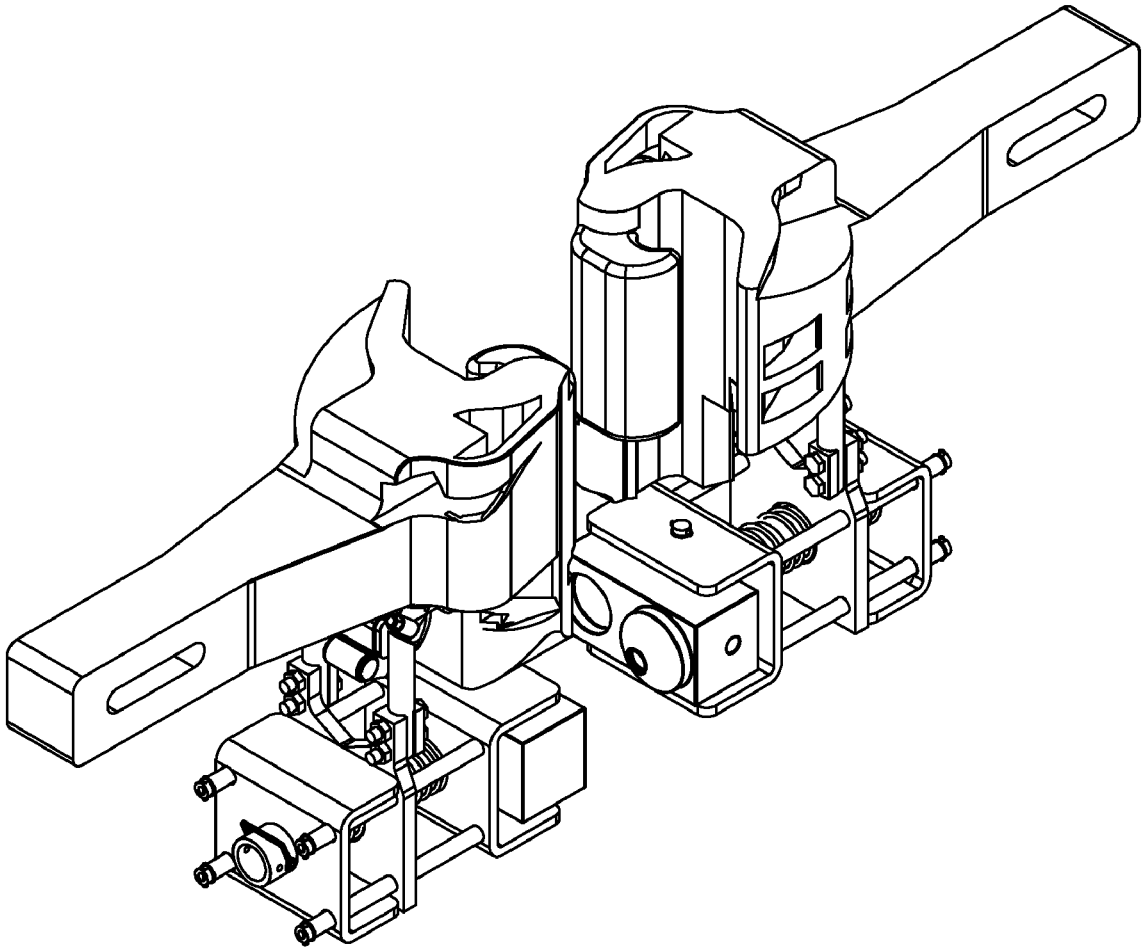
FIG. 5 shows a perspective view of two airhose couplers approaching each other.

As shown in FIG. 4 and FIG. 5, when two railcars with the automatic airhose coupler are mechanically joined via the knuckle coupler, the male coupling means of the first car mates with the female coupling means of the second car, and the female coupling means of the first car mates with the male coupling means of the second car.

ANNEX 1

Glossary of Terms

The following terms are defined and shall be construed as follows:

"Including" means "including without limitation."

"Mechanical coupler assembly" means all the various parts of a mechanical coupler, including the drawbar, rotary shaft, coupler head, hinge pin, and jaw (also called the knuckle).

"Or" means inclusive or. Thus, "A or B" is true if either or both A and B are true.

What is claimed is:

1. An automatic hose connector for a railcar, comprising:

a. a coupler head configured to mate with a corresponding coupler head of another railcar, said coupler head comprising i. a concave female coupling means and a convex male coupling means, each said coupling means including an airway for joining with a corresponding airway of the corresponding coupler head of another railcar;

ii. and at least one internal channel joining the male coupling means and female coupling means airways b. said coupler head attached to a mechanical coupler assembly of said railcar via a mounting bracket wherein said coupler head is mounted to a yoke and is capable of rotating relative to said mounting bracket.

2. The automatic hose connector of claim 1, in which a flexible grommet surrounds the airway of the female coupling means, permitting an airtight seal with a corresponding male coupling means of another railcar.

3. The automatic hose connector of claim 1, further comprising a lip on the male coupling means and female coupling means.

4. The automatic hose connector of claim 1, in which the internal channel exits the coupler head from a surface not containing the coupler means.

5. The automatic hose connector of claim 4, in which the internal channel exits the coupler head on one side of the coupler head.

6. The automatic hose connector of claim 1, further comprising connecting means for detachably connecting the coupler head to a hose.

7. The automatic hose connector of claim 6, in which the connecting means is a gladhand fitting.

8. The automatic hose connector of claim 1, further comprising a coupler housing for holding such coupler head in position to mate with the corresponding coupler head of another railcar, said coupler housing comprising a. a front assembly comprising a yoke holding the coupler head and allowing it to pivot in a horizontal plane;

b. a rear assembly for connecting the coupler housing to a mounting bracket; and c. a mounting bracket that can be rigidly affixed to a mechanical coupler assembly.

9. The automatic hose connector of claim 8, in which the mounting bracket is rigidly affixed to a rotary shaft housing of a mechanical coupler assembly.

10. The automatic hose connector of claim 8, in which the connecting means for the front assembly and rear assembly is a plurality of struts.

11. The automatic hose connector of claim 10, in which the length of the struts is adjustable.

12. The automatic hose connector of claim 8, further comprising a tension mechanism to push the coupler head toward a complementary coupler head of an adjacent railcar.

13. The automatic hose connector of claim 12, in which the tension mechanism is a spring.

14. An automatic hose connector for a railcar, comprising:

a. a coupler head adapted to mate with a corresponding coupler head of another railcar, said coupler head further comprising i. convex male coupling means and concave female coupling means, each said coupling means including an airway for joining with a corresponding airway of the corresponding coupler head of another railcar;

ii. at least one internal channel joining the female and male coupling means airways within the coupler head;

b. connecting means for detachably connecting the coupler head to a hose;

c. a coupler housing for holding such coupler head in position to mate with the corresponding coupler head of another railcar, such coupler housing further comprising:

i. a front assembly comprising a yoke holding the coupler head and allowing it to pivot in a horizontal plane;

ii. a rear assembly for connecting the coupler housing to a mounting bracket;

iii. a plurality of struts connecting the front assembly and rear assembly;

iv. a tension mechanism comprising a spring; and v. a mounting bracket that can be rigidly affixed to a mechanical coupler assembly;

d. said coupler head attached to said mechanical coupler assembly of said railcar via said mounting bracket wherein said coupler head is mounted to said yoke and is capable of rotating relative to said mounting bracket.

* * * * *